US009580085B2

(12) United States Patent
Schmidt

(10) Patent No.: US 9,580,085 B2
(45) Date of Patent: Feb. 28, 2017

(54) PASSENGER TABLE

(71) Applicant: SIEMENS AKTIENGESELLSCHAFT, Munich (DE)

(72) Inventor: Gerhard Schmidt, Essen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/888,716

(22) PCT Filed: Apr. 22, 2014

(86) PCT No.: PCT/EP2014/058062
§ 371 (c)(1),
(2) Date: Nov. 3, 2015

(87) PCT Pub. No.: WO2014/180651
PCT Pub. Date: Nov. 13, 2014

(65) Prior Publication Data

US 2016/0082984 A1 Mar. 24, 2016

(30) Foreign Application Priority Data

May 7, 2013 (DE) ..... 10 2013 208 362

(51) Int. Cl.
*A47B 96/00* (2006.01)
*B61D 37/00* (2006.01)

(52) U.S. Cl.
CPC ..... *B61D 37/00* (2013.01)

(58) Field of Classification Search
CPC ..... Y10T 403/49; Y10T 403/4916; Y10T 403/4933; Y10T 403/4941; Y10T 403/4949; A47B 96/02; A47B 96/027; A47B 96/028; A47B 96/061; A47B 96/067; A47B 31/06; A47B 5/02; B61D 37/00
(Continued)

(56) References Cited

U.S. PATENT DOCUMENTS 2,357,668 A * 9/1944 Laham ..... B60N 3/002 108/143
2,831,715 A * 4/1958 Becker ..... F16B 12/42 403/276
(Continued)

FOREIGN PATENT DOCUMENTS

DE 3624156 C1 11/1987
DE 4206781 * 9/1992
(Continued)

*Primary Examiner* — Janet M Wilkens
(74) *Attorney, Agent, or Firm* — Laurence Greenberg; Werner Stemer; Ralph Locher

(57) ABSTRACT

A passenger table for connection to a side wall of a rail vehicle and for orientation in the transverse direction of the rail vehicle, includes a side wall pillar for connection to the side wall and a table panel supported by the side wall pillar. A horizontal support bar extends from the side wall pillar and, at a distance from the side wall pillar, is connected to the table panel by plastically deformable connection elements in such a manner that, when the plastically deformable connection elements are deformed, the support bar is movable in a horizontal plane relative to the table panel.

8 Claims, 1 Drawing Sheet

(58) Field of Classification Search
USPC ..... 108/152, 44, 45, 48
See application file for complete search history.

(56) References Cited

U.S. PATENT DOCUMENTS 3,250,235 A * 5/1966 McDonnell ..... A47F 5/0823 108/152
3,437,214 A * 4/1969 Sainsbury ..... A47B 96/067 108/152
3,574,394 A * 4/1971 VonPongracz ..... A47B 83/02 108/152
3,704,675 A * 12/1972 Bellasalma ..... A47B 5/02 108/152
4,093,297 A * 6/1978 Reiber ..... A47J 43/283 221/210
4,304,398 A * 12/1981 Crowell ..... B23B 31/12 248/177.1
4,381,715 A * 5/1983 Forman ..... A47B 96/066 108/102
4,390,193 A * 6/1983 Strahan ..... B62D 1/11 280/750
5,953,999 A * 9/1999 Kanehl ..... B60N 3/007 108/44
6,164,610 A * 12/2000 Santiago ..... A47B 96/066 211/90.01
7,658,153 B1 * 2/2010 Patoka ..... B60R 11/00 108/152
8,082,859 B2 * 12/2011 Sevack ..... A47B 96/066 108/152
8,757,068 B2 6/2014 Schmidt
2011/0206894 A1 8/2011 Tsai

FOREIGN PATENT DOCUMENTS

DE 102009034511 1/2011
EP 1195307 A1 4/2002
EP 2574518 A1 4/2013
GB 1212219 * 11/1970

* cited by examiner

PASSENGER TABLE

BACKGROUND OF THE INVENTION

Field of the Invention

The invention relates to a passenger table for connection to a side wall of a rail vehicle and for orientation in the transverse direction of the rail vehicle, having a side wall pillar for connection to the side wall and a table panel which is supported by means of the side wall pillar.

Such a passenger table is known, for example, from DE 10 2009 034 511 A1. In this passenger table, measures are taken to reduce the potential for injury to passengers in the event of collisions. To this end, the table panel is as a whole secured to a body of the rail vehicle in a flexible manner. In the embodiment described in this instance, the flexibility of the table panel with respect to the body is produced by the side wall pillar having a plastically deformable portion which acts as an articulation. This embodiment enables a free capacity for construction of the table panel since the entire functionality is concentrated on providing the flexibility in the side wall pillar. However, it is perceived to be disadvantageous with this passenger table that the side wall support has a relatively large spatial requirement and is constructed in a complex manner.

BRIEF SUMMARY OF THE INVENTION

Based on this, an object of the invention is to develop the passenger table mentioned in the introduction in such a manner that the spatial requirement is decreased and the structure is simplified.

This object is achieved with the passenger table mentioned above in that there extends from the side wall pillar a horizontal support bar which is connected to the table panel with spacing from the side wall pillar by means of plastically deformable connection elements in such a manner that, when the plastically deformable connection elements are deformed, the support bar can move in a horizontal plane relative to the table panel.

This passenger table is distinguished with respect to the prior art set out above in that the configuration of the side wall pillar involves a smaller spatial requirement, whilst the entire construction of the passenger table is simplified. Since the support bar is connected with a spacing from the side wall pillar to the table panel in a plastically deformable manner, there are produced with respect to the passenger table according to the prior art smaller spacings with respect to the load introduction locations which are to be anticipated on the table panel and the resultant displacement torques.

The support bar may be arranged below the table panel or, if less structural space is available, in a recess at the lower side of the table panel. In this manner, the table panel is carried in a reliable manner by the support bar.

The plastically deformable connection elements may be constructed as links. As a result of suitable arrangement of the links between the support bar and the table panel, a movement of the table panel relative to the support bar in the event of a collision can be determined in an appropriate manner.

Preferably, the links form an articulated gear mechanism which defines a vertical rotation axis for a relative movement between the support bar and the table panel. This rotation axis may be real or notional.

Preferably, the vertical rotation axis is located with spacing from the side of the table panel associated with the side wall, which spacing corresponds to at least a quarter of the length of the table panel. This ensures that the rotation axis is located further from the side wall of the rail vehicle than the impact location to be anticipated against the table edge of the passenger sitting closest to the side wall.

In a further preferred manner, the vertical rotation axis is located with spacing with respect to the side of the table panel associated with the side wall of the rail vehicle, which spacing corresponds to at least three-quarters of the length of the table panel. In this instance, the rotation axis is arranged upstream of the impact location which is to be anticipated against the table edge of a passenger at the gangway side or even further in the direction of the gangway region. Then, the rotation of the table panel with respect to the support bar is independent of the impact of the passenger, which is advantageous for determining the characteristics for the deformability of the plastically deformable connection elements.

The above embodiment relates to a passenger table which is arranged in the transverse direction of a rail vehicle and at each of the two sides of which two passengers are seated, respectively. The arrangement of the vertical rotation axis by configuration of the articulated gear mechanism is intended to be adapted if there are provided a different number of passengers at the sides of the passenger table.

The links may have a plastics articulation at each of the two ends thereof. It is thereby ensured that, in the event of a collision, the movement of the table panel relative to the support bar is clearly defined, since a deformation of the links occurs exclusively at the portions which are configured as a plastics articulation.

In order to further support the table panel, supports which extend horizontally from the support bar may be provided. This contributes to enabling a reliable vertical support of the table panel.

Preferably, energy-absorbing elements are provided between the table panel and the support bar. This means that, in the event of a collision, the force acting on the deformable connection elements can be determined by means of the configuration of the energy-absorbing elements.

Preferably, the horizontally extending supports and the energy-absorbing elements may be combined to form a structural and functional unit.

The plastically deformable connection elements may preferably be releasably secured to the table panel. In this instance, it is possible to replace the table panel which is subjected to high wear in a simple manner, wherein the carrier structure provided with a support bar and side wall pillar may be retained.

BRIEF DESCRIPTION OF THE SEVERAL VIEWS OF THE DRAWING

An embodiment of the invention is explained in even greater detail below with reference to the drawings, in which.

DESCRIPTION OF THE INVENTION

Figure 1:
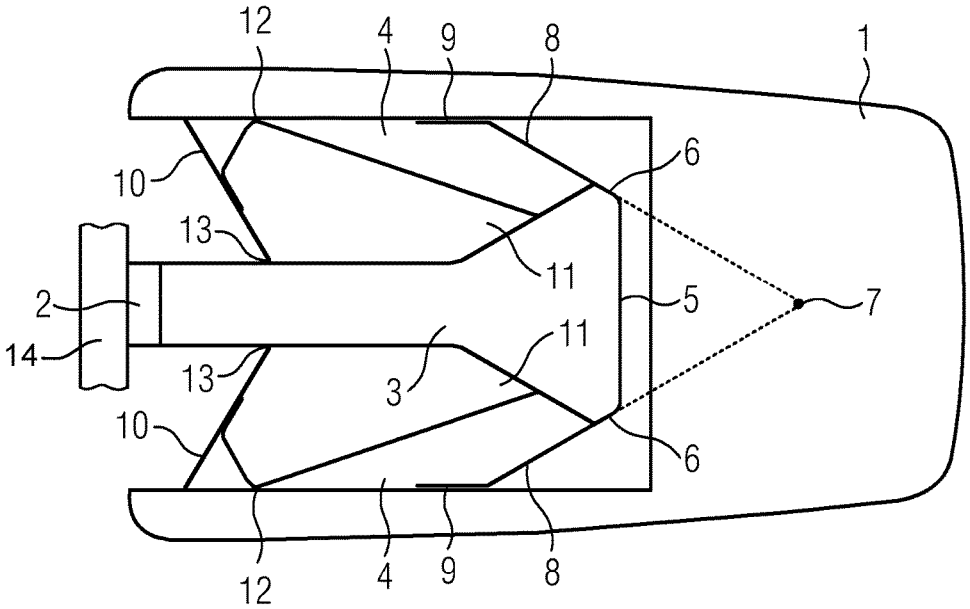
FIG. 1 is a cross-sectional view of a passenger table in the state in use.

A passenger table which is illustrated in FIG. 1 has a table panel 1 which is supported by means of a vertical side wall column 2 for connection to the side wall 14 of a rail vehicle and a horizontal support bar 3 which extends from the upper end of the side wall pillar 2. In this instance, the support bar 3 extends from the upper end of the side wall pillar 2 in a floor-side recess 4 of the table panel 1. Substantially at the center of the table panel 1, the initially linear support bar 3 extends at both sides thereof in an oblique manner outward and terminates with an end face 5.

Between the end face 5 of the support bar 3 and the portions which extend outward in an oblique manner there are located at both sides of the support bar 3 portions 6 which extend inward in an oblique manner as far as the edges of the end face 5. Imaginary, linear extensions of the portions 6 meet at a location on a center axis of the table panel 1. This location defines a rotation axis 7.

The support bar 3 is connected by means of plastically deformable links 8 to vertical inner sides of the recess 4 by means of a releasably fitted assembly flange 9. In this instance, a transition region between the assembly flange 9 and the link 8 and a transition region between the link 8 and the associated portion 6 of the support bar 3 is constructed as a plastics articulation. In the basic state of the passenger table illustrated in FIG. 1, the links 8 are in alignment with the portions 6 of the support bar so that the links 8 together form an articulated gear mechanism which forces the table panel 1 in the event of plastic deformation of the links 8 approximately around a circular path about the vertical rotation axis 7.

In order to further support the table panel 1, there are used supports 10 which extend from the support bar 3 and which extend obliquely in the direction of the side wall of the rail vehicle and which can only touch the table panel 1 but are not secured thereto. In a structural unit with the supports 10, there are provided energy-absorbing elements 11 which each have a contact portion 12 with respect to the vertical inner sides of the recess 4. Furthermore, the energy-absorbing elements 11 extend along the support bar 3 from a connection location 13 of the supports 10 as far as the region of the portions of the support bar 3 which extend in an oblique manner outward.

Figure 2:
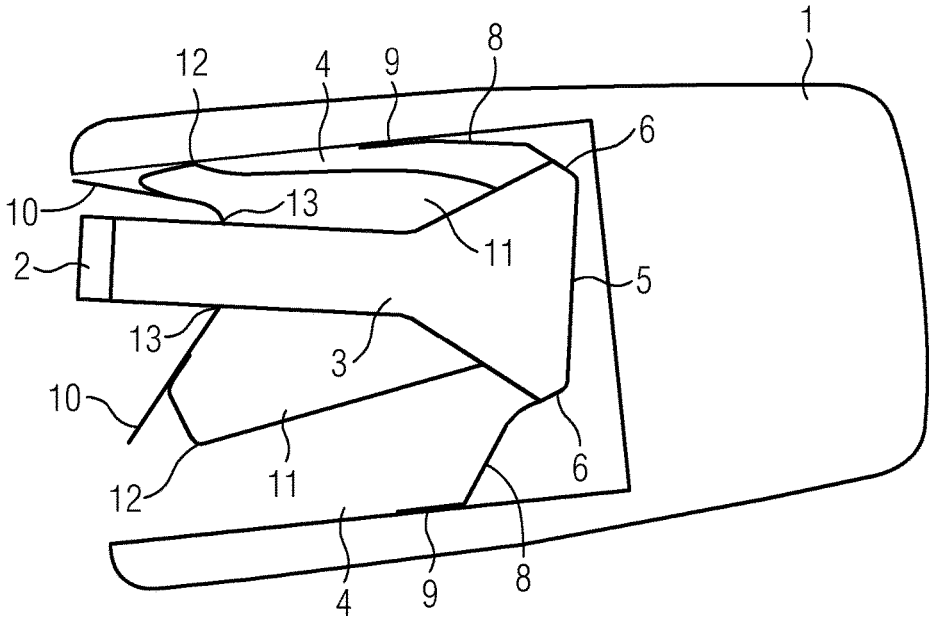
FIG. 2 is a cross-sectional view of the passenger table according to FIG. 1 after a collision has occurred.

FIG. 2 shows the passenger table according to FIG. 1 in the event that, in FIG. 2, the side-wall-side end of the table panel 1 is moved downward, for example, in the event of a collision. In this instance, the transition regions which are constructed as plastics articulations between the assembly flanges 9 and the link 8 and between the link 8 and the portion 6 of the support bar 3 become deformed. In addition, the energy-absorbing element 11 which is illustrated at the top in FIG. 2 is compressed. A configuration of the properties of the energy-absorbing elements 11 enables the relative movement which occurs in the event of a collision between the table panel 1 and the fixed structural unit comprising the side wall pillar and support bar 3 to be adjusted in an appropriate manner. The rotation movement which is produced is carried out about the vertical rotation axis 7 which is located at least three-quarters of the length of the table panel away from the side of the table panel associated with the side wall of the rail vehicle.

The invention claimed is:

1. A passenger table for connection to a side wall of a rail vehicle and for orientation in a transverse direction of the rail vehicle, the passenger table comprising:

a side wall pillar for connection to the side wall of the rail vehicle;

a table panel supported by said side wall pillar;

a horizontal support bar extending from said side wall pillar; and plastically deformable connection elements connecting said horizontal support bar to said table panel at a spacing from said side wall pillar, said plastically deformable connection elements being constructed as links forming an articulated gear mechanism defining a vertical rotation axis for a relative movement between said horizontal support bar and said table panel;

said horizontal support bar being movable in a horizontal plane relative to said table panel upon deformation of said plastically deformable connection elements.

2. The passenger table according to claim 1, wherein said horizontal support bar is disposed below said table panel or in a recess formed at a lower side of said table panel.

3. The passenger table according to claim 1, wherein:

said table panel has a length and a side associated with the side wall of the rail vehicle;

said vertical rotation axis is located at another spacing from said side of said table panel; and said other spacing corresponds to at least one-quarter of said length of said table panel.

4. The passenger table according to claim 3, wherein said other spacing corresponds to at least three-quarters of said length of said table panel.

5. The passenger table according to claim 1, wherein said links have ends and a plastics articulation at each respective end.

6. The passenger table according to claim 1, which further comprises supports extending horizontally from said horizontal support bar for supporting said table panel.

7. The passenger table according to claim 1, which further comprises energy-absorbing elements provided between said table panel and said horizontal support bar.

8. The passenger table according to claim 1, wherein said plastically deformable connection elements are releasably secured to said table panel.

* * * * *